US007039956B1

(12) United States Patent
Hsia

(10) Patent No.: US 7,039,956 B1
(45) Date of Patent: May 9, 2006

(54) FOLDABLE/EXPANDABLE BIBS

(76) Inventor: Chih-Yu Hsia, 301 Warren Way, Arcadia, CA (US) 91007

( * ) Notice: Subject to any disclaimer, the term of this patent is extended or adjusted under 35 U.S.C. 154(b) by 0 days.

(21) Appl. No.: 11/311,074

(22) Filed: Dec. 19, 2005

(51) Int. Cl.
*A41B 13/10* (2006.01)

(52) U.S. Cl. ..... 2/49.1; 2/49.2; 2/52

(58) Field of Classification Search ..... 2/48, 2/49.1, 49.2, 49.3, 49.4, 49.5, 50–52, 46, 2/80, 114, 83, 207; D2/860–864
See application file for complete search history.

(56) References Cited

U.S. PATENT DOCUMENTS 1,980,436 A * 11/1934 Reagan ..... 2/48
2,174,694 A * 10/1939 Elson ..... 2/49.2
2,580,388 A * 1/1952 Allen ..... 2/49.1
2,742,644 A * 4/1956 Kaufman ..... 2/49.2
2,760,200 A * 8/1956 Shamyer, Jr. ..... 2/49.2
2,830,297 A * 4/1958 Sabee ..... 2/49.4
3,654,629 A * 4/1972 Crisman et al. ..... 2/49.1
3,747,122 A * 7/1973 Goldberg ..... 2/48
4,660,226 A * 4/1987 Quilling et al. ..... 2/49.2
5,477,560 A * 12/1995 Shope ..... 2/49.1
5,822,792 A * 10/1998 Reinhart, Jr. ..... 2/49.1
5,930,836 A * 8/1999 Morris ..... 2/49.1
6,061,827 A * 5/2000 Lampson et al. ..... 2/49.1
6,345,392 B1 * 2/2002 Rios ..... 2/48
6,530,089 B1 * 3/2003 Frye ..... 2/49.2

* cited by examiner

*Primary Examiner*—Amy B. Vanatta

(57) ABSTRACT

A foldable/expandable bib consisting of a sheet of thin flexible foldable material which has two strips on opposite edges; the strips having many open slots that can engage with each other; the openings of the slots of one strip facing one direction while the openings of the slot of another strip facing the opposite direction; the sheet having many creases which are substantially perpendicular or parallel to the strips; the strips having creases which are substantially transverse to the strips; the sheet and the strips being able to be folded/expanded along the creases; one of the strip optionally having a tab which extends sideways from the strip and which has many creases along which the tab can be folded/expanded to become a sheath for the bib; the tab having an area or areas that is coated with sticky material; the tab optionally having a slot that can engage with a tip of the tab.

5 Claims, 15 Drawing Sheets

FOLDABLE/EXPANDABLE BIBS

BACKGROUND OF THE INVENTION

1. Field of the Invention

This invention relates to bibs that are foldable/expandable and that can catch food debris dropped from biting.

2. Descriptions of the Prior Arts

No prior art related to foldable/expandable bibs was found.

SUMMARY OF THE INVENTION

Eating foods on a car or on a sofa usually results in food debris spread everywhere. Generally, food debris firstly drops on the clothes of the eater. Then the food debris may roll down to the floor or spread on the seat. A device which is lightweight and easy to carry around and which can prevent food debris from soiling clothes then rolling off of a eater is sought.

The invented foldable/expandable bibs will be made of sheets of lightweight thin flexible foldable material such as paper. The sheets will have creases along which the sheets can be folded into relatively small packages for carrying. Each of the invented bibs can have a sheath that enables it to stay in the small and compacted manner. The invented bib can be expanded to form a trough at its end to catch food debris.

These and other objects and advantages of the invention, as well as the details of illustrative embodiments, will be more fully understood from the following specification and drawings, in which:

DRAWING DESCRIPTION

FIG. 1 is a plan view of a fully expanded invented device.

FIGS. 2 through 13 illustrate the folding of the bib in processes. FIG. 2 illustrates the beginning of the folding processes. FIG. 13 illustrates the ending of the folding processes.

GENERAL DESCRIPTION

Figure 1:
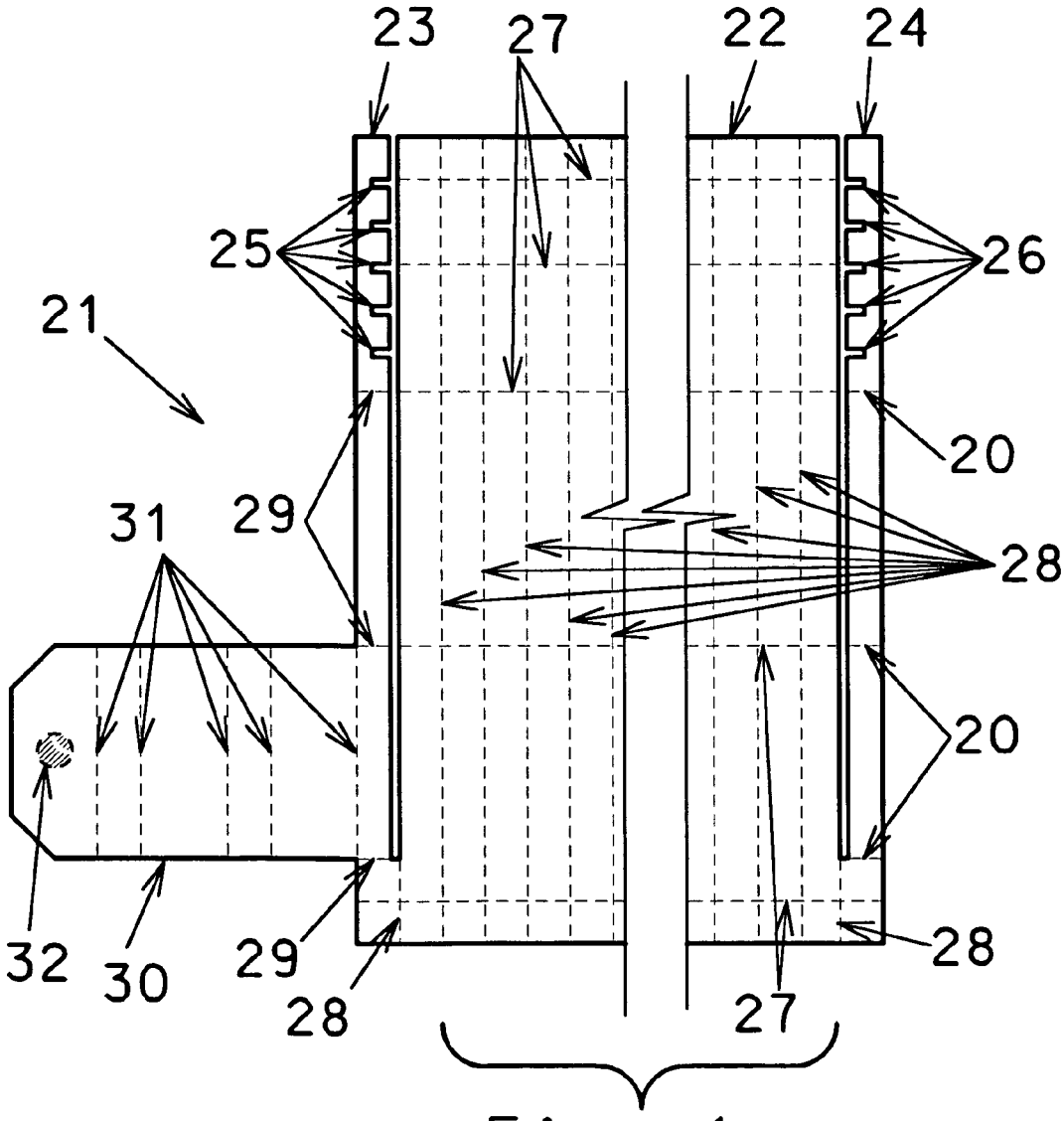

Referring to FIG. 1, a fully expanded invented foldable/expandable bib 21 consists of a sheet of thin flexible foldable material (such as paper) 22 that has two strips 23 and 24 (one on each opposite side). There are many slots 25 and 26 along the edges of each of the strips 23 and 24, respectively. The openings of the slots 25 and 26 are facing each other. There are also many creases 27, 28, 29 and 20 on the thin flexible foldable material and the two strips. A tab 30 is optionally attached to the strip 23. The tab also has many creases 31 and an area 32 that is coated with sticky material. The area is near the free edge of the tab. The invented device is foldable/expandable along those creases.

Figure 11:
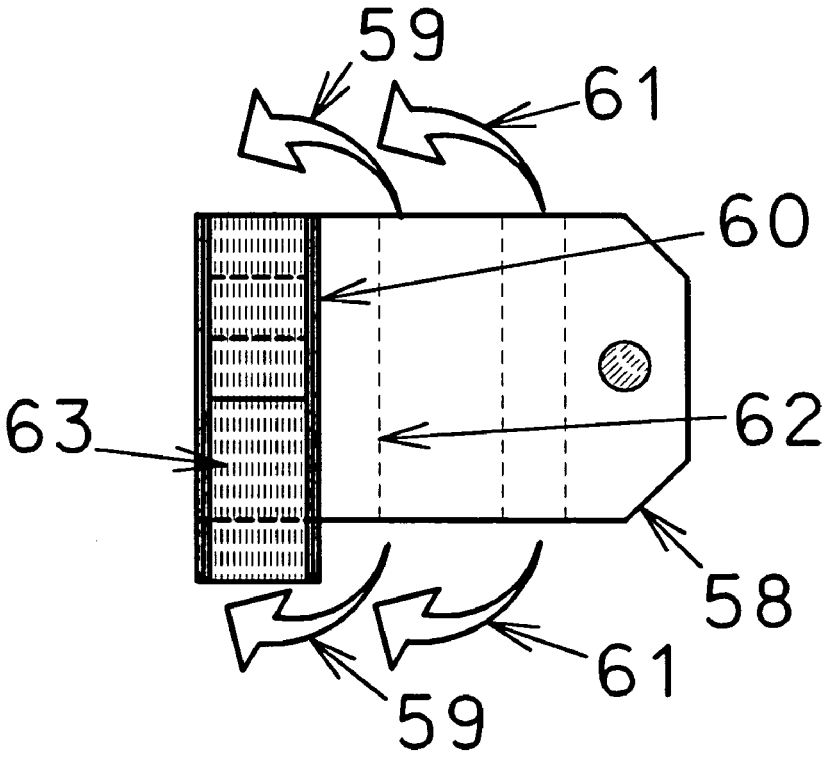
Figure 12:
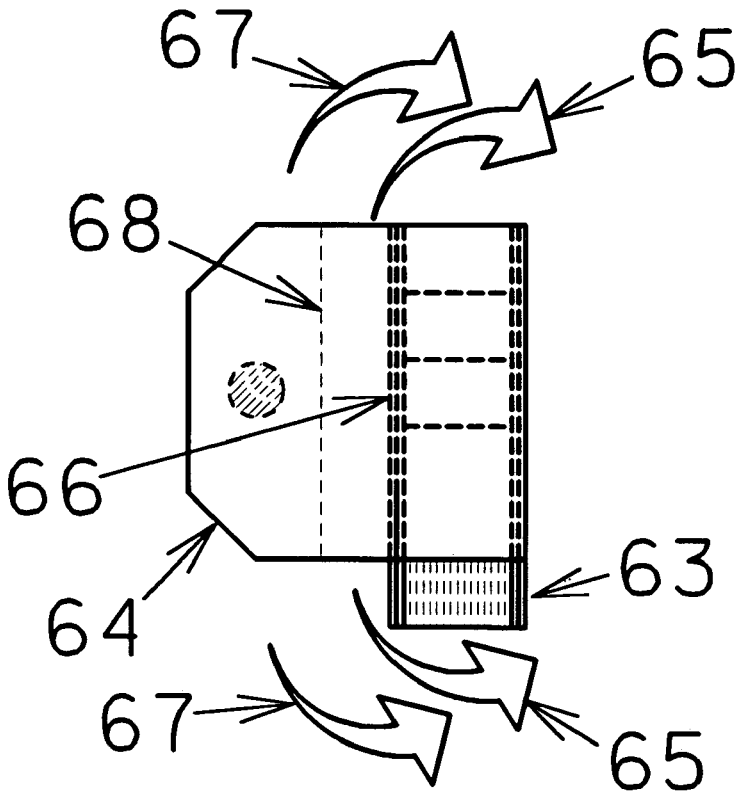
Figure 13:
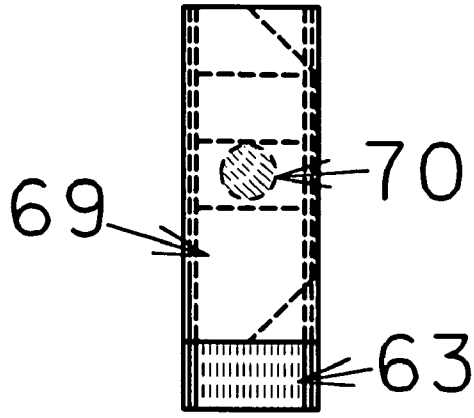

Referring to FIGS. 2 through 13, a fully expanded invented device can be folded into a relatively compacted small package (see FIG. 13).

Figure 2:
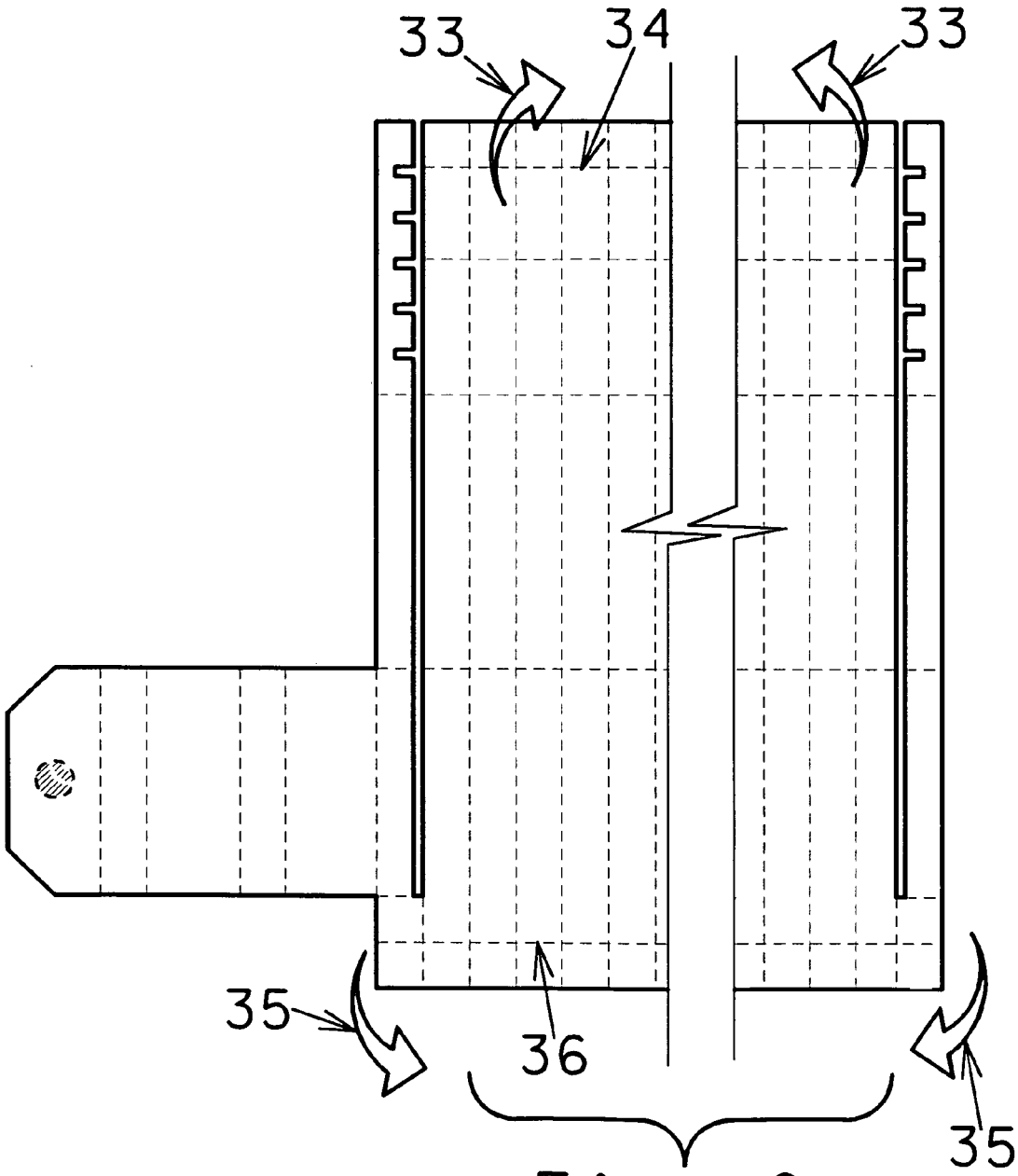
Figure 3:
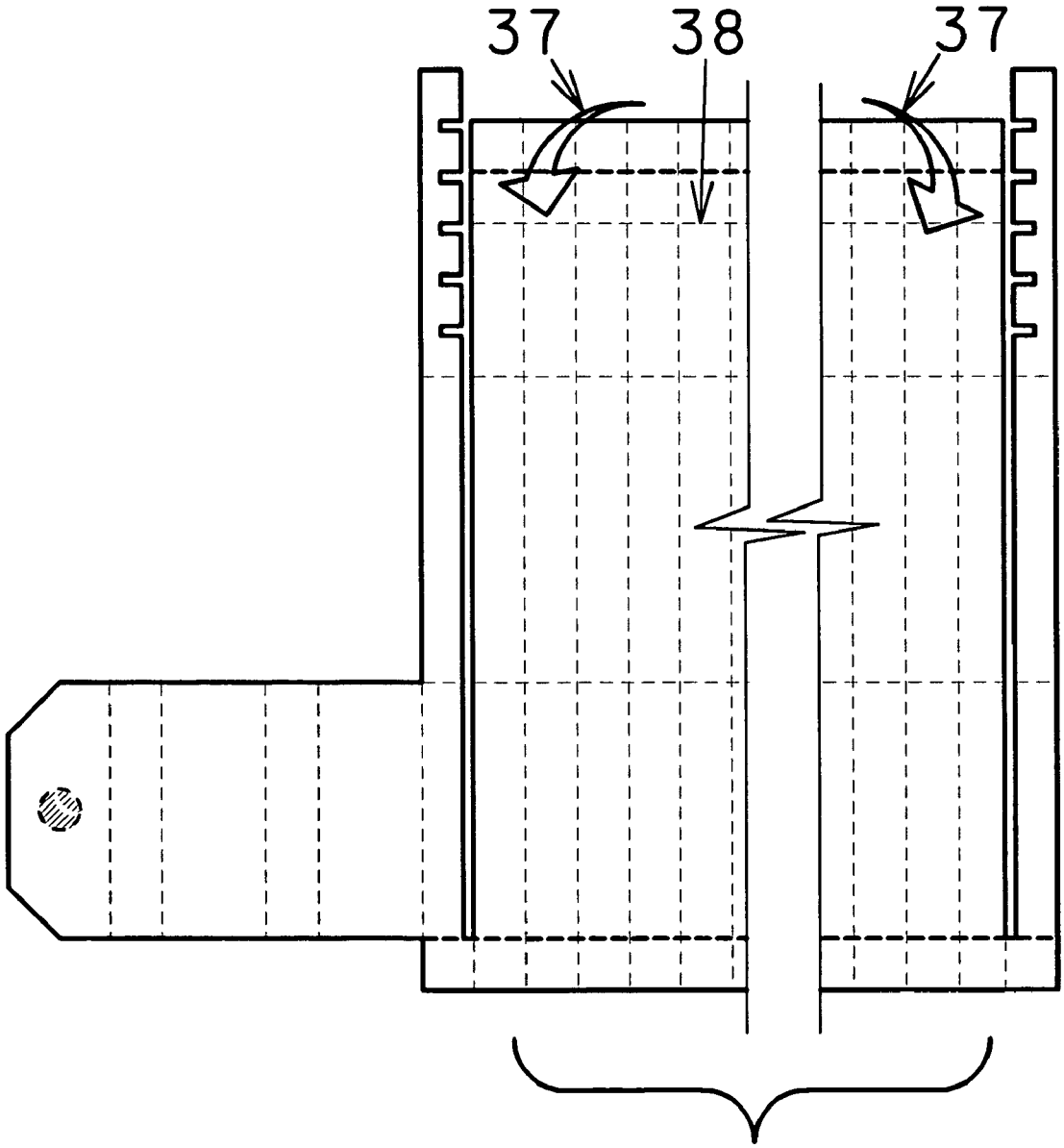
Figure 4:
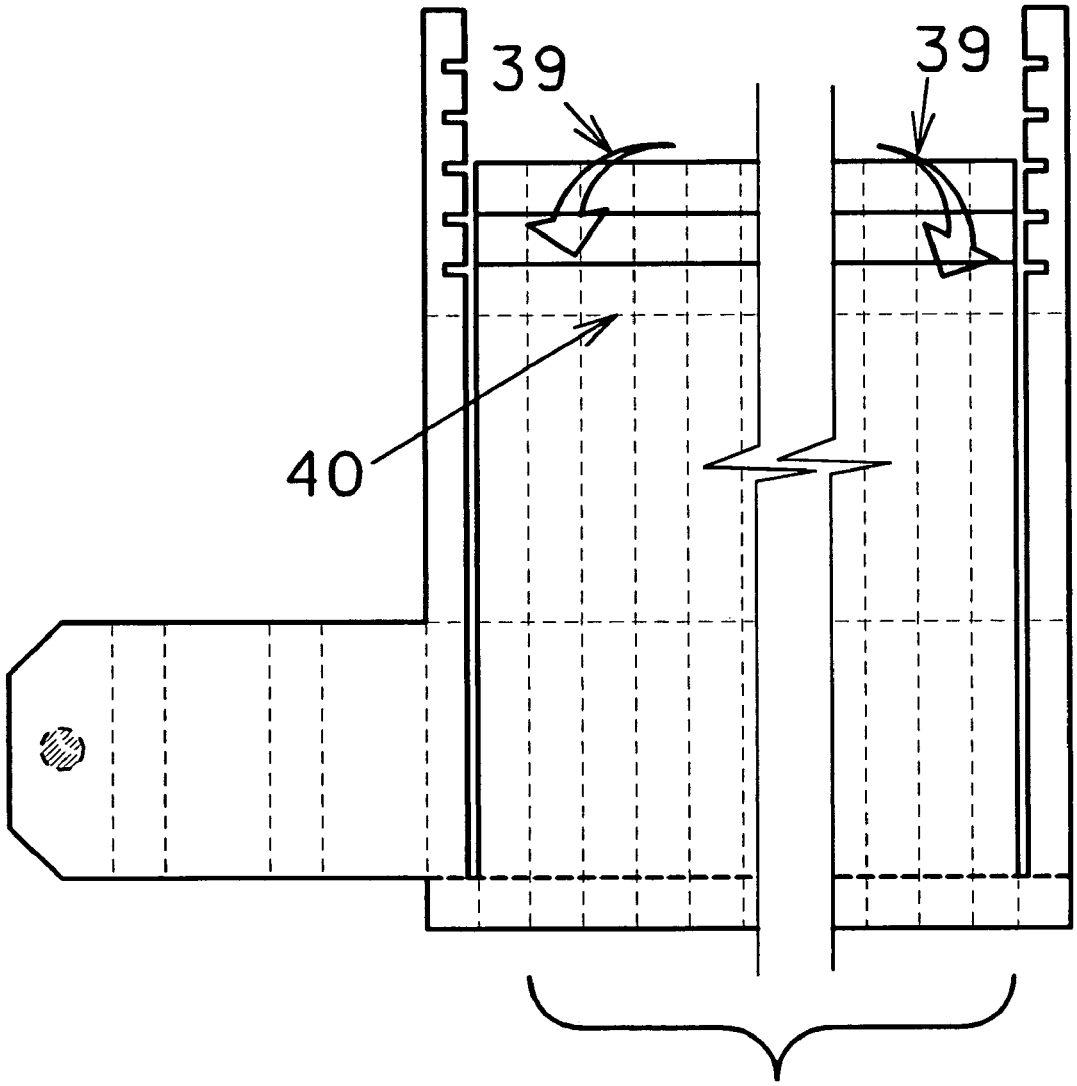
Figure 5:
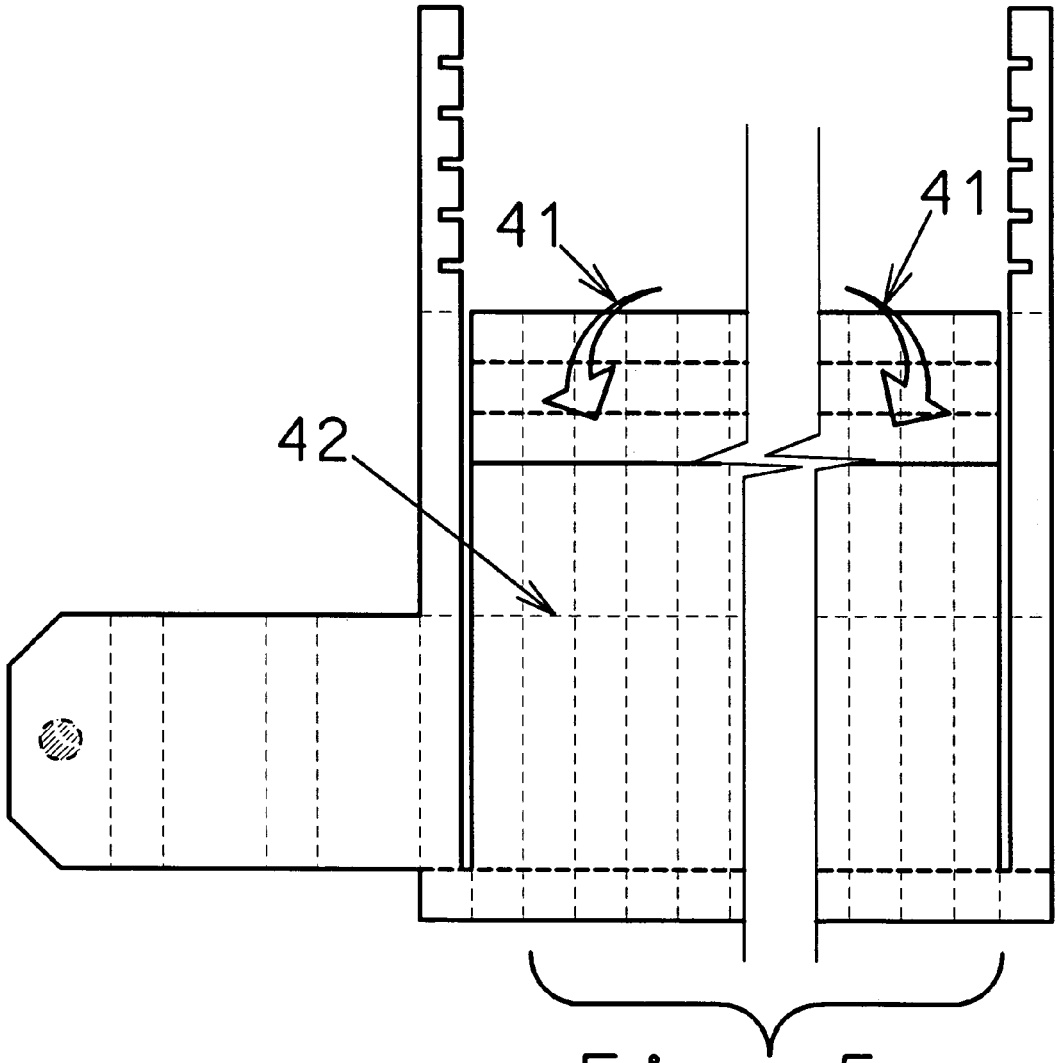

Referring to FIG. 2, the first two folding will be along the creases 34 and 36 which are the creases closest to the edges which do not have the strips. The folding directions 33 and 35 are toward backwards. Referring to FIG. 3, the second folding will be along the crease 38 and the folding direction 37 will be forwards. Referring to FIG. 4, the third folding will be along the crease 40 and the folding direction 39 will be forwards. Referring to FIG. 5, the fourth folding will be along the crease 42 and the folding direction 41 will be forwards.

Figure 6:
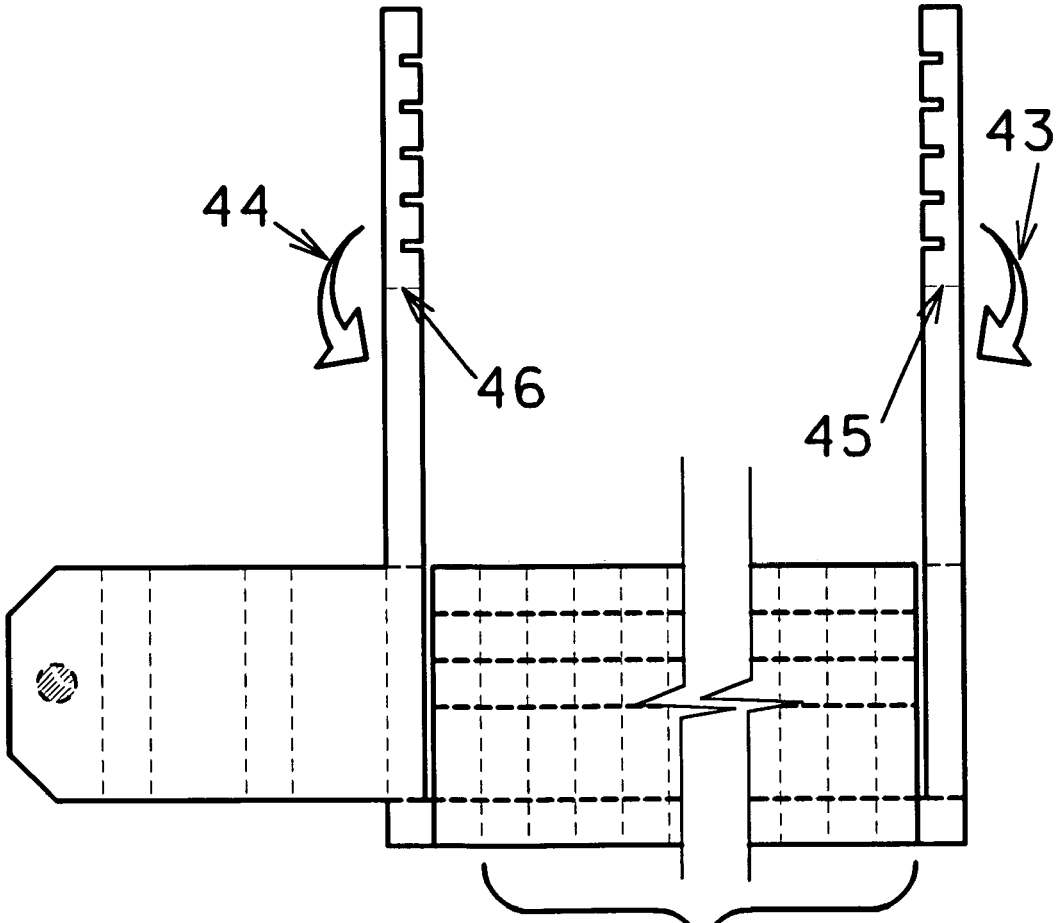
Figure 7:
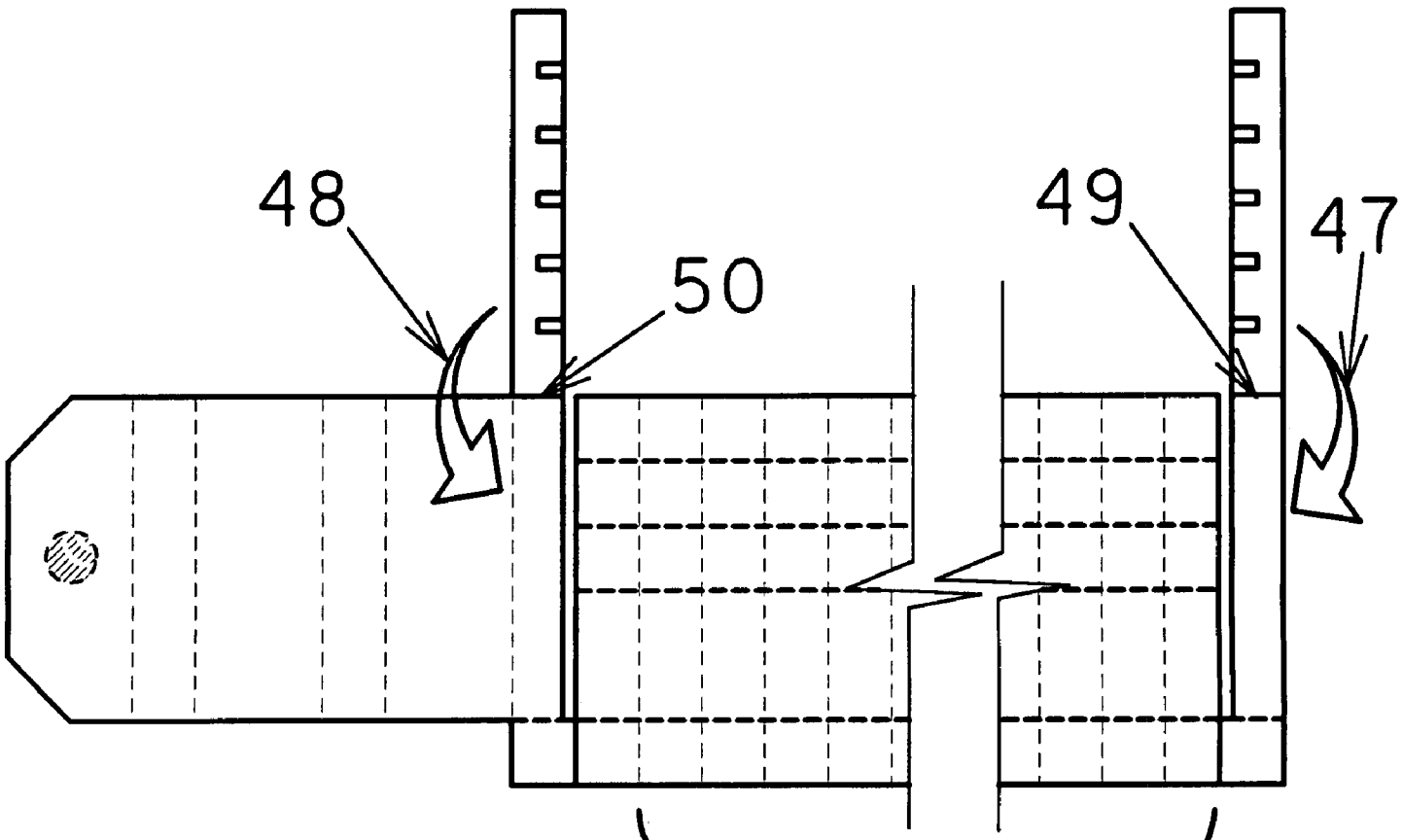

Referring to FIG. 6, the two strips will be folded forwardly (in the directions 43 and 44) along the creases 45 and 46, respectively. Referring to FIG. 7, the two strips will be folded again forwardly (directions 47 and 48) along the creases 49 and 50, respectively.

Figure 8:
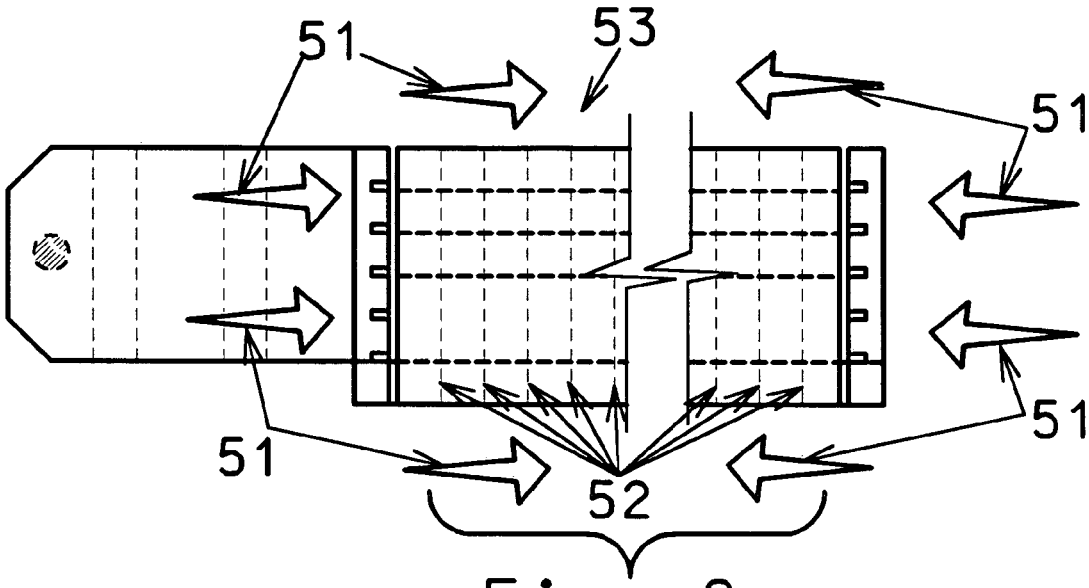
Figure 9:
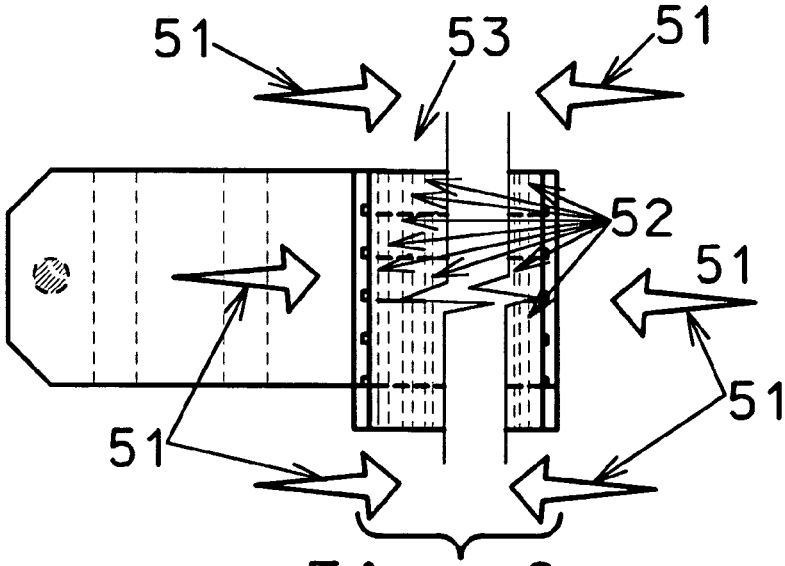

Referring to FIGS. 8 and 9, the already transversely folded thin flexible foldable material 53 will be folded along creases 52. The folding will be forward and backward bi-directions along any two adjacent creases. The overall folding directions 51 is to put the folded strips to as close as possible.

Figure 10:
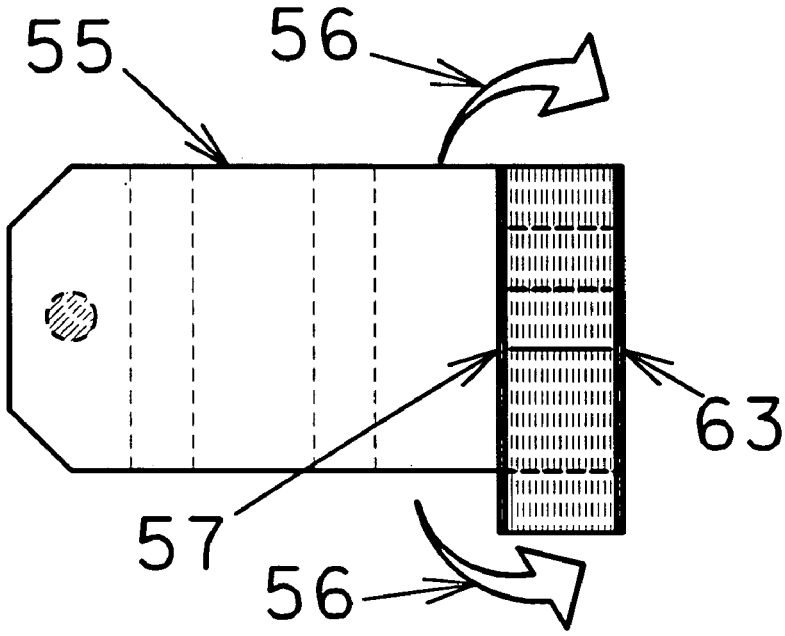

Referring to FIG. 10, the tab 55 will be folded following the folding direction 56 along the crease 57 to fold behind the already folded bib 63. Referring to FIG. 11, the tab 58 will be folded following the folding directions 59 and 61 along the creases 60 and 62, respectively, to wrap around the already folded bib 63. Referring to FIG. 12, the tab 64 will be folded again following the folding directions 65 and 67 along the creases 66 and 68, respectively, to wrap around the already folded bib 63. Referring to FIG. 13, the sticky material 70 will stick on the back of the already folded tab 69. The folded bib then will wrap up the folded bib 63.

To unfold the folded bib, a user firstly needs to pull the tab to cause the tab not to be glued on the back of the tab itself. Then, the user follows the reverse processes (referring to FIG. 13 backward through 2). However, the user needs not to unfold all the way back to the FIG. 2 stage to use an expanded bib.

Figure 14:
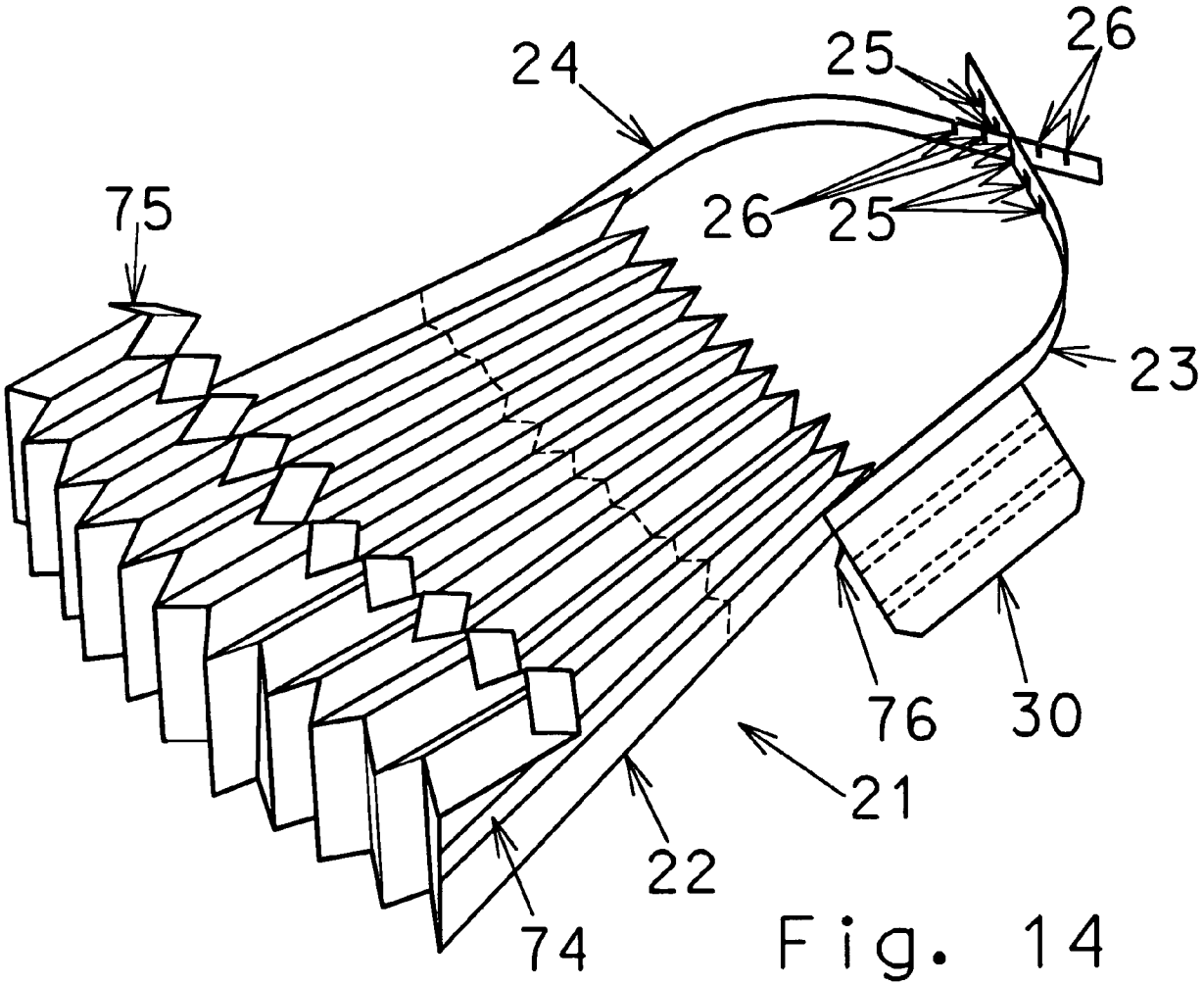
FIG. 14 is an isometric view of the invented device in functional position.
Figure 15:
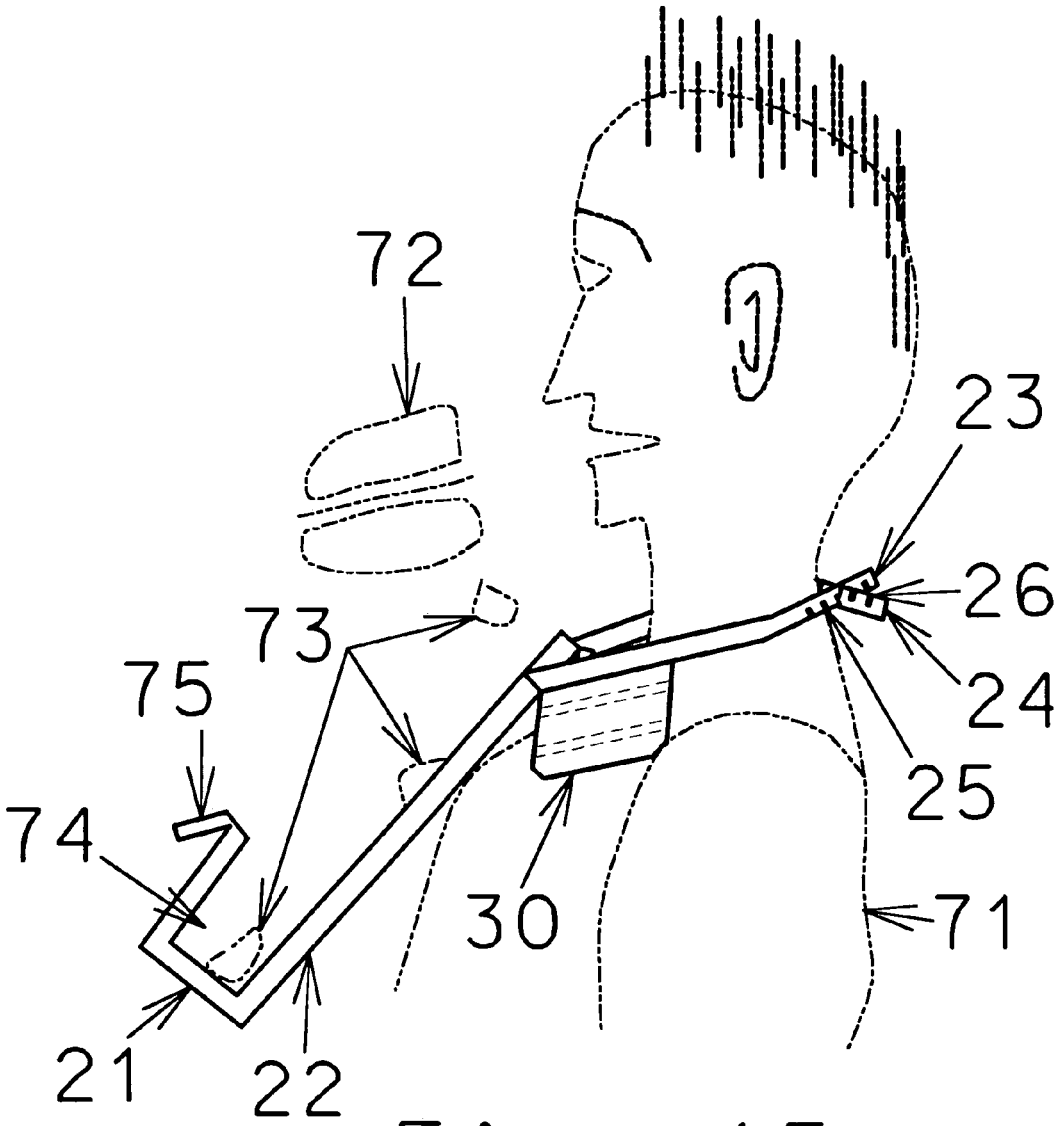
FIG. 15 is a schematic view that illustrates the function of the invented device.

Referring to FIGS. 14 and 15, to use the foldable/expandable bib 21, the user 71 unfolds the sheet of the thin flexible foldable material 22 of the bib until a trough 74 which cross-section resembles a "U" is formed at the bottom edge of the bib. The user unfolds the two strips 23 and 24 upward then puts the unfolded strips around his/her neck. Then, the user connects the two strips together by engaging two slots, one from each strip, together. The bib then can be used.

Referring to FIG. 15, when the user 71 bites the food 72, some food debris 73 will fall from the food. The bib not only prevent the food debris from staining the user clothes, the trough 74 of the bib further keeps the food debris from rolling off the bib. The bent-over sections, 75 and 76, which are the first bends of the thin flexible foldable material 22, will provide additional rigidities but also not so sharp edges to the bib.

Three other variations of the invented devices are also presented.

Figure 16:
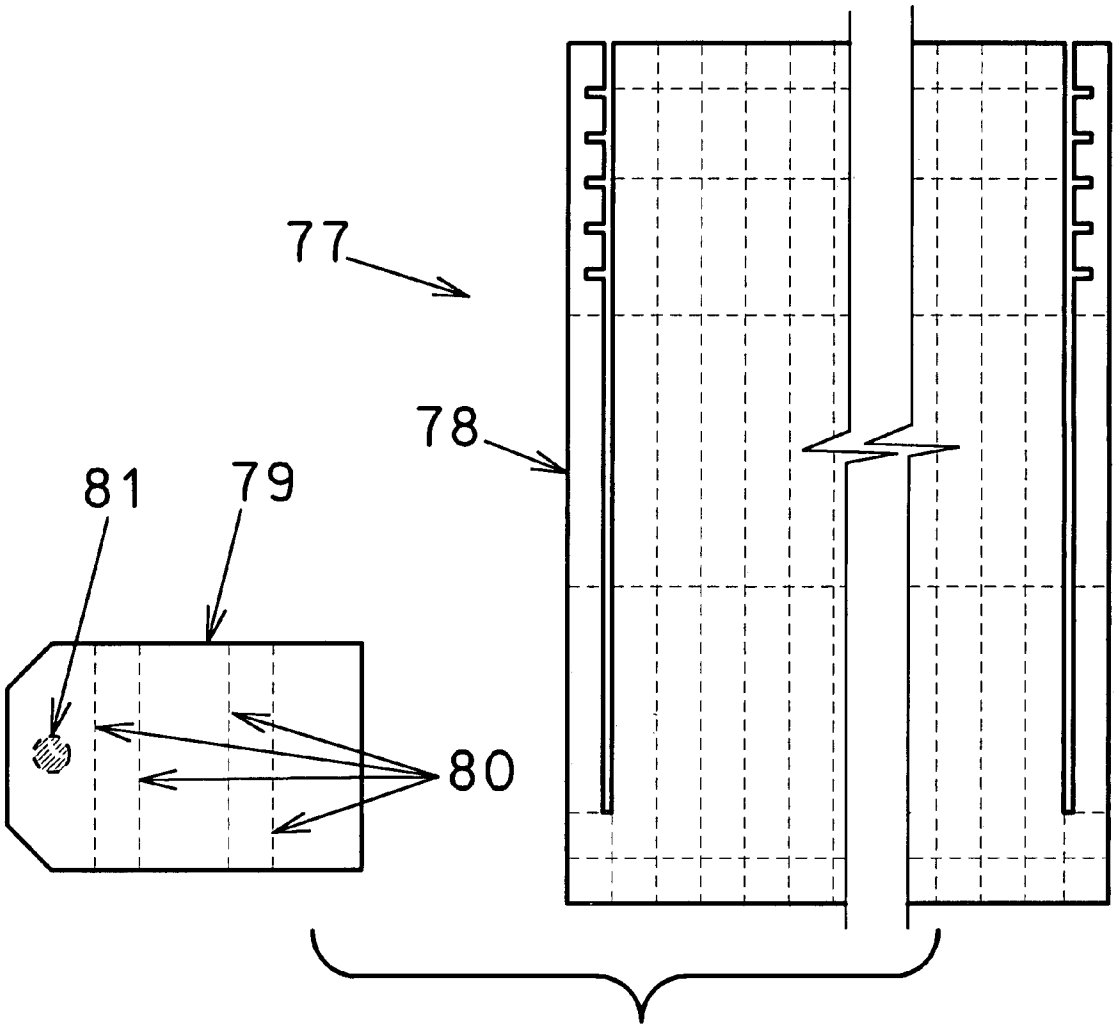
FIG. 16 is a variation of the invented device.

Referring to FIG. 16, one variation of the invented foldable/expandable bib 77 consists of two sheets of thin flexible foldable material 78 and 79 which are similar to 22 and 30 described previously for those of FIG. 1. The sheet 78 can be folded in a similar way like those described for the sheet 22 of FIG. 1. The sheet 79 can be folded along the creases 80 to form a sheath for the folded bib. The sticky area 81 can keep the folded sheet 79 in the sheath form.

Figure 17:
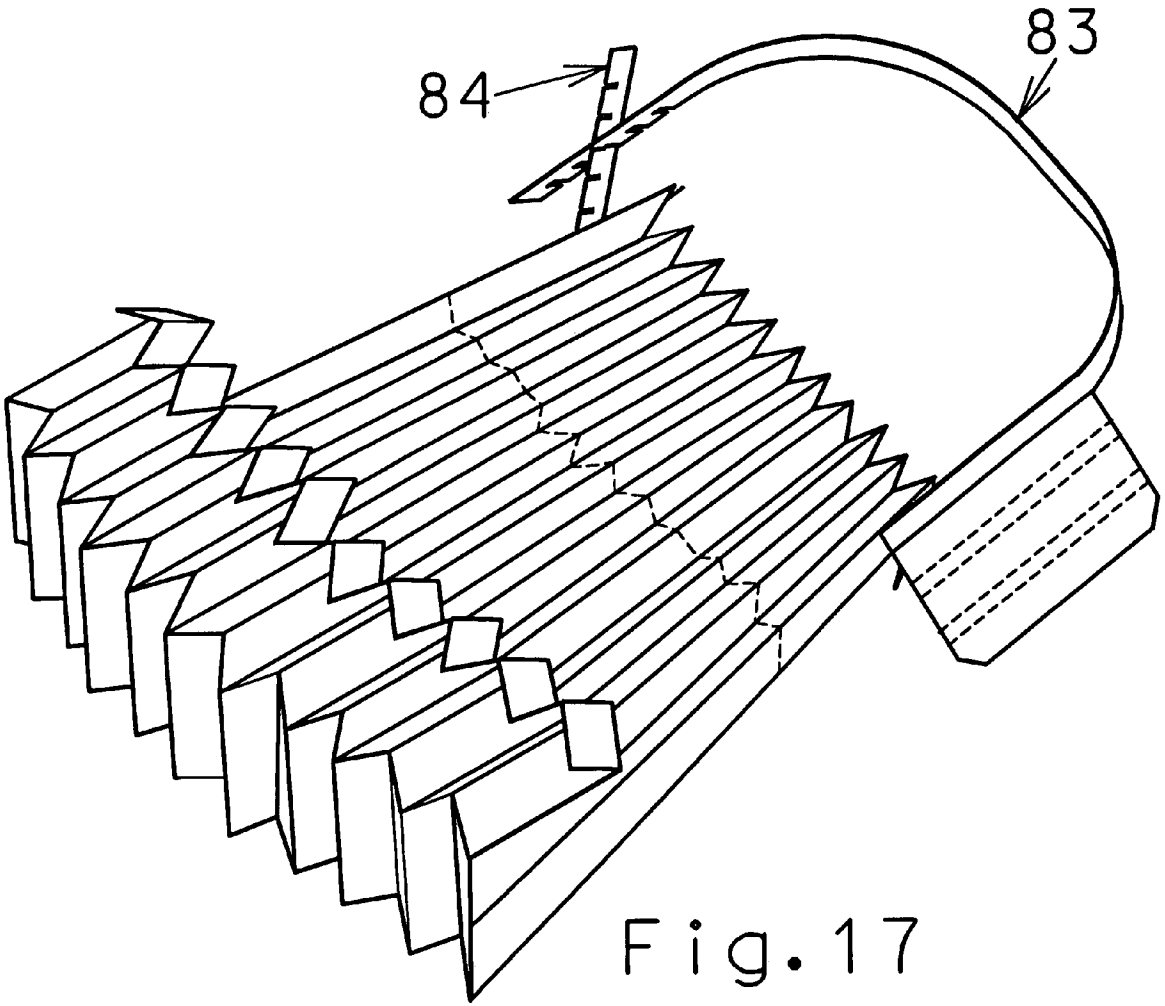
FIG. 17 is another variation of the invented device.

The two strips of the sheet of the thin flexible foldable material may not have the same lengths. Referring to FIG. 17, one strip 83 of the other variation of the invented foldable/expandable bib is significantly longer than the other strip 84. In this variation, the user can join the two strips by engaging two slots of the two strips in the front where he/she can see and easily make the engagement.

Figure 18:
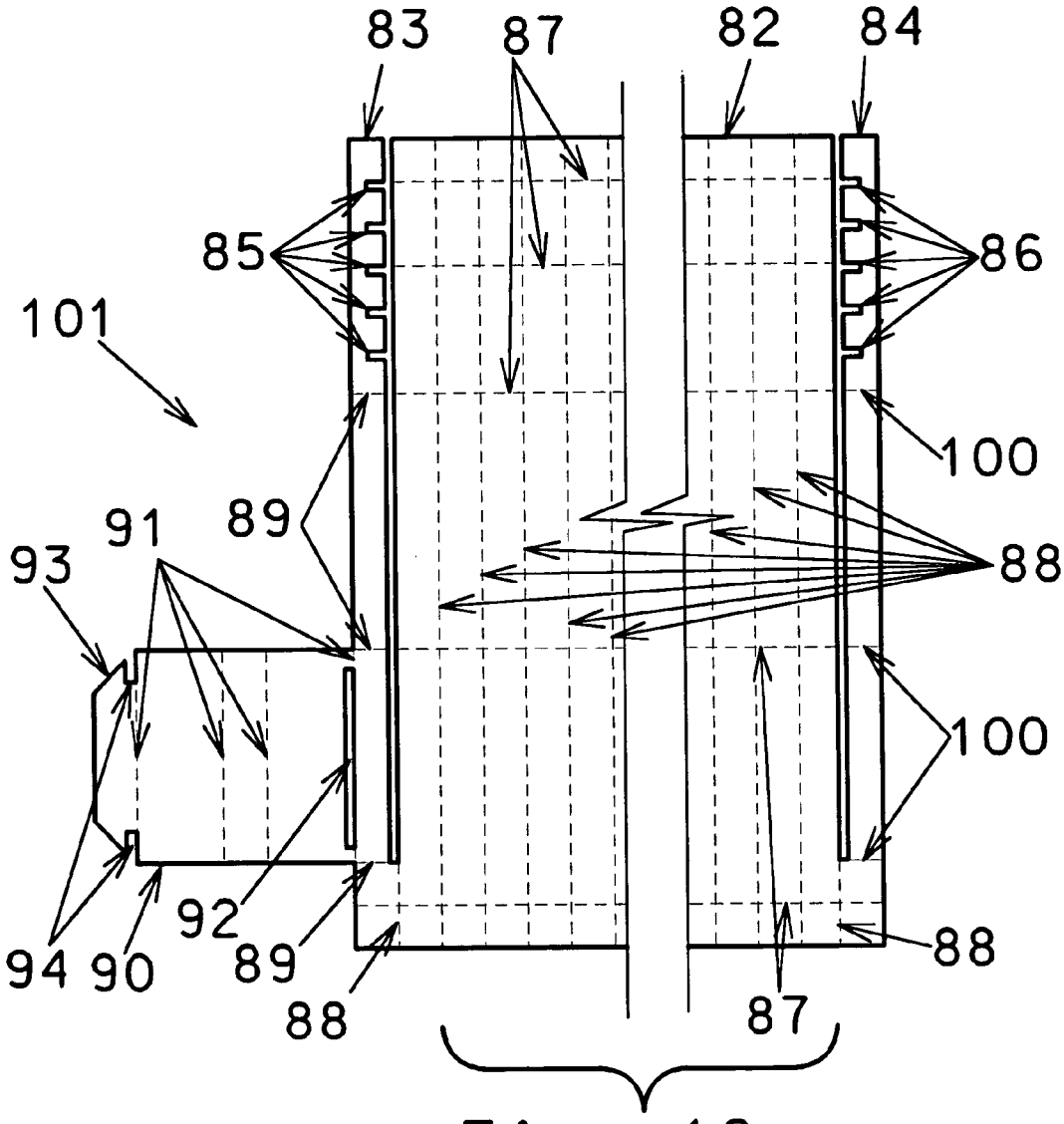
FIG. 18 is the fourth variation of the invented device.

Referring to FIG. 18, a fully expanded another variation of the invented foldable/expandable bib also consists of a sheet of thin flexible foldable material 82. The sheet also has two strips 83 and 84, many slots 85 and 86, and many creases 87, 88, 89 and 100, similar to those of FIG. 1. A tab 90 is attached to the strip 83. The tab also has many creases 91 and a slot 92. The tip 93 has two slots 94 that can engage with the slot 92 when the tip 93 is inserted into the slot 92. The invented device is also foldable/expandable along those creases.

The folding processes/procedures of the variation of FIG. 18 are similar to those of FIG. 1 except that the tip 93 of the tab 90 will be inserted into the slot 92 to keep the folded tab 90 to be the sheath of the folded bib. To expand the folded bib, the user needs to pull the tip 93 out of the slot 92 then to unfold the bib just like those processes/procedures described for the variation shown in FIG. 1.

The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents, may be resorted to, falling within the scope of the invention as claimed.

I claim:

1. A foldable/expandable bib consisting of:

a) a sheet of thin flexible foldable material;

b) a strip of thin flexible foldable material being on one edge of said sheet;

c) another strip of thin flexible foldable material being on the opposite edge of said sheet;

d) said strip having a slot in multiple form along the long edge near the free end of said strip;

e) said another strip having a slot in multiple form along the long edge near the free end of said another strip;

f) the openings of said slot of said strip facing one direction while the openings of said slot of said another strip facing the opposite direction;

g) said sheet having a crease in plural form which are substantially perpendicular to said strip;

h) said sheet having a crease in plural form which are substantially parallel to said strip;

i) said strip having a crease in plural form which are substantially transverse to said strip;

j) said another strip having a crease in plural form which are substantially transverse to said another strip;

k) said sheet being able to be folded/expanded along its said crease which is substantially perpendicular to said strip;

l) said sheet being able to be folded/expanded along its said crease which is substantially parallel to said strip;

m) said strip being able to be folded/expanded along its said crease;

n) said another strip being able to be folded/expanded along its said crease;

o) said slot of said strip being able to engage with said slot of said another strip.

2. A foldable/expandable bib of claim 1 in which said strip has a tab which extends sideways from said strip; has a crease in plural form; and is able to be folded/expanded along said crease.

3. A foldable/expandable bib of claim 2 in which said tab has an area that is coated with sticky material.

4. A foldable/expandable bib of claim 2 in which said tab has an area in plural form that is coated with sticky material.

5. A foldable/expandable bib of claim 2 in which said tab has a slot that can engage with a tip of said tab.

* * * * *